US011788735B2

(12) United States Patent
Kageyama et al.

(10) Patent No.: US 11,788,735 B2
(45) Date of Patent: Oct. 17, 2023

(54) HEATING AND HOT-WATER SUPPLY DEVICE

(71) Applicant: NORITZ CORPORATION, Hyogo (JP)

(72) Inventors: Akihisa Kageyama, Hyogo (JP); Hiroshi Morimoto, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 74 days.

(21) Appl. No.: 17/284,782

(22) PCT Filed: Apr. 8, 2019

(86) PCT No.: PCT/JP2019/015297

§ 371 (c)(1),
(2) Date: Apr. 12, 2021

(87) PCT Pub. No.: WO2020/084813

PCT Pub. Date: Apr. 30, 2020

(65) Prior Publication Data

US 2022/0003431 A1 Jan. 6, 2022

(30) Foreign Application Priority Data

Oct. 25, 2018 (JP) ..... 2018-200615
Jan. 28, 2019 (JP) ..... 2019-011897

(51) Int. Cl.
*F24D 3/08* (2006.01)
*F24D 19/10* (2006.01)

(52) U.S. Cl.
CPC ..... *F24D 19/1069* (2013.01); *F24D 3/08* (2013.01); *F24D 2200/04* (2013.01); *F24D 2220/0207* (2013.01); *F24D 2220/042* (2013.01)

(58) Field of Classification Search
CPC ..... F24D 3/00; F24D 3/08; F24D 19/1069; F24D 2200/04; F24D 2220/042; F24D 2220/0207
(Continued)

(56) References Cited

U.S. PATENT DOCUMENTS 8,291,869 B2 * 10/2012 Min ..... F23N 5/242 122/18.1
9,886,043 B2 * 2/2018 Yuge ..... F24D 19/1051
(Continued)

FOREIGN PATENT DOCUMENTS

JP S4948746 4/1974
JP 2005337632 12/2005
(Continued)

OTHER PUBLICATIONS

"International Search Report (Form PCT/ISA/210) of PCT/JP2019/015297", dated Jun. 18, 2019, with English translation thereof, pp. 1-2.

*Primary Examiner* — Steven B McAllister
*Assistant Examiner* — John E Bargero
(74) *Attorney, Agent, or Firm* — JCIPRNET

(57) ABSTRACT

A heating and hot-water supply device includes a combustion means, a heat exchanger, a circulation passage, a circulation means, a bypass passage, a distribution means, a hot-water supply heat exchanger, a water supply passage, a hot-water supply passage, and a control means. The heat exchanger heats a heating heat-medium to a target heat medium temperature. The distribution means distributes the heating heat-medium to the circulation passage and the bypass passage. The control means is capable of adjusting a distribution ratio of the distribution means to be adaptable to a heating operation, a hot-water supply operation, and a simultaneous heating and hot-water supply operation. At the time of transition from the heating operation to the simul-
(Continued)

taneous heating and hot-water supply operation, in a case where the heating terminal for performing heating is a warm air heater, the control means raises the target heat medium temperature.

3 Claims, 4 Drawing Sheets

(58) Field of Classification Search
USPC ..... 237/8 A
See application file for complete search history.

(56) References Cited

U.S. PATENT DOCUMENTS

| | | | | |
|---|---|---|---|---|
| 2011/0017152 | A1* | 1/2011 | Min | F24D 3/08 236/12.15 |
| 2015/0300661 | A1* | 10/2015 | Park | F24D 3/08 122/20 R |
| 2016/0047558 | A1* | 2/2016 | Shimada | F24D 3/02 237/63 |
| 2017/0363301 | A1* | 12/2017 | Son | F24D 19/1051 |
| 2018/0073749 | A1* | 3/2018 | Gagne | F24H 1/124 |
| 2020/0386418 | A1* | 12/2020 | Choi | F24H 9/20 |

FOREIGN PATENT DOCUMENTS

| | | |
|---|---|---|
| JP | 20050337632 | * 12/2005 |
| JP | 2018071925 | 5/2018 |
| JP | 2018084392 | 5/2018 |

* cited by examiner

HEATING AND HOT-WATER SUPPLY DEVICE

CROSS-REFERENCE TO RELATED APPLICATION

This application is a 371 application of the International PCT application serial no. PCT/JP2019/015297, filed on Apr. 8, 2019, which claims the priority benefits of Japan Patent Application No. 2018-200615, filed on Oct. 25, 2018 and Japan Patent Application No. 2019-011897, filed on Jan. 28, 2019. The entirety of each of the above-mentioned patent applications is hereby incorporated by reference herein and made a part of this specification.

BACKGROUND

Technical Field

The disclosure relates to a heating and hot-water supply device which heats and supplies a heating heat-medium used for heating and performs hot water supply by using the heating heat-medium.

Related Art

Conventionally, a heating and hot-water supply device, which circulates and supplies a heating heat-medium which has been heated to a heating terminal such as a warm air heater and performs hot water supply by using the heat of the heating heat-medium, is used for central heating which collectively heats the inside of a house. For example, Patent Document 1 discloses a heating and hot-water supply device which adjusts the amount of fuel supplied according to the temperature of the heating heat-medium as heated in order to adjust the heat according to each value of the temperature of heating and the amount of hot water supply.

The warm air heater includes a heating heat exchanger and a blower which exchange heat between the heating heat-medium and air, the air in the room is sent to the heating heat exchanger by the blower, and the air heated by the heating heat exchanger is blown into the room as warm air. A radiator and a floor heating device which heat by radiant heat of the heating heat-medium and natural convection of air are also often used as the heating terminal other than the warm air heater.

The heating and hot-water supply device includes a combustion part which burns a fuel, a heat exchanger which exchanges heat between the heating heat-medium and a high-temperature combustion gas generated in the combustion part, and a hot-water supply heat exchanger which exchanges heat between the heating heat-medium and water for hot water supply. In a heating operation, the heating heat-medium is circulated between the heat exchanger and the heating terminal. In a hot-water supply operation, water heated by the hot-water supply heat exchanger by the heating heat-medium is supplied.

RELATED ART DOCUMENTS

Patent Documents

Patent Document 1: Japanese Utility Model Application Laid-Open No. 49-48746

SUMMARY

Problems to be Solved

Generally, the heating operation of central heating is performed continuously, for example, throughout the winter period, while the hot-water supply operation is performed only during hot water supply regardless of the season and often ends in a shorter time than the heating operation. When hot water supply is started during the heating operation and the operation switches to a simultaneous heating and hot-water supply operation of simultaneously performing the heating operation and the hot-water supply operation, hot water supply is prioritized, the heat supplied to the heating terminal is reduced, and the heating capacity drops.

At this time, if the heating terminal for performing heating is a radiator or a floor heating device, even if the radiant heat or the like is reduced, the human body can hardly perceive it. On the other hand, when the heating terminal for performing heating is a warm air heater as in Patent Document 1, the temperature of the warm air blown by the warm air heater drops, and the lower-temperature warm air may directly hit the human body and cause discomfort such as coldness, which is not desirable.

An objective of the disclosure is to provide a heating and hot-water supply device which can reduce the discomfort that may be caused to a user due to transition from a heating operation to a simultaneous heating and hot-water supply operation.

Means for Solving the Problems

A heating and hot-water supply device according to a first aspect includes a combustion means, a heat exchanger, a circulation passage, a circulation means, a bypass passage, a distribution means, a hot-water supply heat exchanger, a water supply passage, a hot-water supply passage, and a control means. The heat exchanger heats a heating heat-medium to a target heat medium temperature by heat generated by the combustion means. The circulation passage connects the heat exchanger to an external heating terminal. The circulation means is provided in the circulation passage to circulate the heating heat-medium. The bypass passage is branched off from the circulation passage and bypasses the heating terminal. The distribution means distributes the heating heat-medium to the circulation passage and the bypass passage. The hot-water supply heat exchanger is provided in the bypass passage. The water supply passage supplies tap water to the hot-water supply heat exchanger. The hot-water supply passage supplies water, which is heated by the hot-water supply heat exchanger, at a predetermined hot-water supply setting temperature. The control means controls at least the combustion means, the circulation means, and the distribution means. The control means is capable of adjusting a distribution ratio of the distribution means to be adaptable to a heating operation, a hot-water supply operation, and a simultaneous heating and hot-water supply operation. At the time of transition from the heating operation to the simultaneous heating and hot-water supply operation, in a case where the heating terminal for performing heating is a warm air heater, the control means raises the target heat medium temperature.

According to the above configuration, since the target heat medium temperature is raised when transitioning from the heating operation to the simultaneous heating and hot-water supply operation in the case where the heating terminal is a warm air heater, the temperature of the heating heat-medium heated by the heat exchanger becomes higher than that during the heating operation. Therefore, even if the heating heat-medium is distributed for the hot-water supply operation and the flow rate of the heating heat-medium supplied to the warm air heater drops, since the drop in the heat supplied to the warm air heater can be compensated for by the temperature raise of the heating heat-medium, it is possible to suppress a temperature drop of the warm air of the warm air heater.

In a preferred first form, a temperature detection means for detecting a temperature of the heating heat-medium returning from the heating terminal to the heat exchanger is included. The control means raises the target heat medium temperature in a case where a detection temperature of the temperature detection means drops by a predetermined value or more due to the transition from the heating operation to the simultaneous heating and hot-water supply operation.

According to the above configuration, during the simultaneous heating and hot-water supply operation, in the case where the temperature of the heating heat-medium which is used for heating and returned to the heat exchanger drops by a temperature of a predetermined value or more, the temperature of the heating heat-medium is made higher than that during the heating operation.

Therefore, since the heat supplied to the warm air heater can be increased by the temperature raise of the heating heat-medium, it is possible to suppress a temperature drop of the warm air of the warm air heater.

In a preferred second form, the temperature detection means is arranged on a heating terminal side of a junction part of the circulation passage and the bypass passage.

According to the above configuration, the temperature of the heating heat-medium which is used for heating and returned to the heat exchanger is detected, and it is possible to learn the temperature drop of the warm air of the warm air heater. Therefore, it is possible to set an appropriate target heat medium temperature and suppress the temperature drop of the warm air of the warm air heater.

A heating and hot-water supply device according to a second aspect includes a combustion means, a heat exchanger, a circulation passage, a circulation means, a bypass passage, a distribution means, a hot-water supply heat exchanger, a water supply passage, a hot-water supply passage, and a control means. The heat exchanger heats a heating heat-medium to a target heat medium temperature by heat generated by the combustion means. The circulation passage connects the heat exchanger to an external heating terminal. The circulation means is provided in the circulation passage to circulate the heating heat-medium. The bypass passage is branched off from the circulation passage and bypasses the heating terminal. The distribution means distributes the heating heat-medium to the circulation passage and the bypass passage. The hot-water supply heat exchanger is provided in the bypass passage. The water supply passage supplies tap water to the hot-water supply heat exchanger. The hot-water supply passage supplies water, which is heated by the hot-water supply heat exchanger, at a predetermined hot-water supply setting temperature. The control means controls at least the combustion means, the circulation means, and the distribution means. The control means is capable of adjusting a distribution ratio of the distribution means to be adaptable to a heating operation, a hot-water supply operation, and a simultaneous heating and hot-water supply operation. At the time of transition from the heating operation to the simultaneous heating and hot-water supply operation, in a case where the heating terminal for performing heating is a warm air heater, the control means adjusts the distribution ratio of the distribution means from a heating operation distribution ratio to a predetermined initial distribution ratio different from a hot-water supply operation distribution ratio.

According to the above configuration, by adjusting the distribution ratio of the distribution means to a predetermined initial distribution ratio different from the hot-water supply operation distribution ratio, it is possible to supply more heating heat-medium to the warm air heater than in the case of the hot-water supply operation distribution ratio to alleviate the temperature drop of the warm air.

In a preferred third form, at the time of transition from the heating operation to the simultaneous heating and hot-water supply operation, in a case where the heating terminal for performing heating is not a warm air heater, the control means adjusts the distribution ratio of the distribution means from the heating operation distribution ratio to the hot-water supply operation distribution ratio.

According to the above configuration, when the heating terminal for performing heating is not a warm air heater, even if the distribution ratio is adjusted to the hot-water supply operation distribution ratio to prioritize hot water supply, there is little possibility of causing discomfort to a heating user.

Accordingly, by changing the distribution ratio at the time of transition to the simultaneous heating and hot-water supply operation according to the type of the heating terminal, it is possible to reduce the possibility of causing discomfort to the heating user while prioritizing hot water supply.

In a preferred fourth form, after a predetermined time has elapsed from adjustment of the distribution ratio at the time of transition from the heating operation by the warm air heater to the simultaneous heating and hot-water supply operation, the control means adjusts the distribution means to a distribution ratio according to a heating required capacity and a hot-water supply required capacity.

According to the above configuration, at the beginning of the transition to the simultaneous heating and hot-water supply operation, the distribution means is adjusted to a distribution ratio prioritizing the hot-water supply operation, and after a predetermined time has elapsed in this state, the distribution means is adjusted according to a heating required capacity required for the heating operation and a hot-water supply required capacity required for the hot-water supply operation. Accordingly, after the lapse of the predetermined time, since heat can be supplied to the heating terminal, it is possible to reduce the possibility of causing discomfort to the heating user.

In a preferred fifth form, in a case where the heating terminal for performing heating is a warm air heater, the control means adjusts the distribution ratio so that a distribution rate on a circulation passage side in the initial distribution ratio is set as a lower limit.

According to the above configuration, when the heating terminal for performing heating is a warm air heater, since the distribution ratio of the distribution means is adjusted so that the distribution rate on the circulation passage side in the initial distribution ratio is set as the lower limit, the heat supplied to the warm air heater can be secured.

Effects

According to the heating and hot-water supply device of the application, when transitioning from the heating operation to the simultaneous heating and hot-water supply operation, it is possible to reduce the discomfort such as a temperature drop of the warm air of the warm air heater which may be caused by the transition from the heating operation to the simultaneous heating and hot-water supply operation.

DESCRIPTION OF THE EMBODIMENTS

Hereinafter, the configuration for implementing the disclosure will be described based on the embodiments.

Embodiment 1

Figure 1:
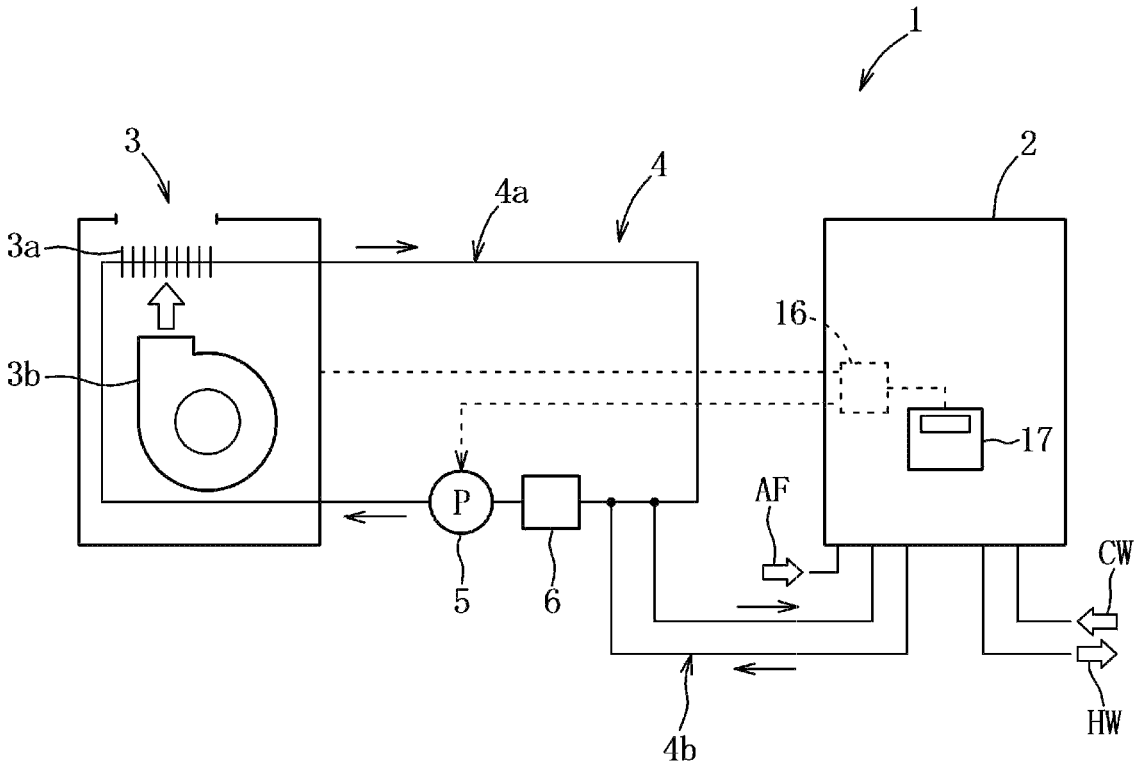
FIG. 1 is a view showing an overall configuration of a hot-water heating system according to an embodiment of the disclosure.

First, the overall configuration of a hot-water heating system 1 used for central heating will be described with reference to FIG. 1.

The hot-water heating system 1 is configured to supply a heating heat-medium (hot water) heated by a heating and hot-water supply device 2 to a heating terminal 3 outside the heating and hot-water supply device 2 so that the heating terminal 3 collectively heats the inside of a house. The hot-water heating system 1 includes a heating and hot-water supply device 2, a heating terminal 3, a heating circulation circuit 4 connected the heating and hot-water supply device 2 and the heating terminal 3, an external pump 5 provided in the heating circulation circuit 4, and a closed expansion tank 6 provided in the heating circulation circuit 4 to absorb a volumetric expansion of the heating heat-medium due to a temperature rise. Although not shown in the figure, when the heating terminal 3 is arranged in each of multiple rooms in the house to supply the heating heat-medium thereto, the heating terminals 3 are connected in parallel to the heating circulation circuit 4.

The heating circulation circuit 4 includes a terminal circulation circuit part 4*a* which circulates and supplies the heating heat-medium to the heating terminal through driving of the external pump 5, and a heating circulation circuit part 4*b* which supplies the heating heat-medium from the terminal circulation circuit part 4*a* to the heating and hot-water supply device 2 and supplies the heating heat-medium heated by the heating and hot-water supply device 2 to the terminal circulation circuit part 4*a*. The expansion tank 6 is provided upstream of the external pump 5 of the terminal circulation circuit part 4*a*. The heating circulation circuit part 4*b* is connected to the upstream of the expansion tank 6 of the terminal circulation circuit part 4*a*.

Next, a warm air heater, a radiator, and a floor heating device used as the heating terminal 3 will be described.

The warm air heater includes a heating heat exchanger 3*a* which performs heat exchange between the heating heat-medium and air, a blower 3*b* which sends air to the heating heat exchanger 3*a* and blows heated air as the warm air into the room, and a heating operation switch which drives and stops the blower 3*b*, to perform heating by forcibly convecting air. The operation of starting/stopping the heating operation and the setting of the heating setting temperature may be performed at the warm air heater.

The radiator includes a heating heat exchanger which performs heat exchange between the heating heat-medium and air, and performs heating by using the radiant heat of the heating heat-medium and natural convection of air. The floor heating device is configured by covering a floor material on a hose which is arranged at an appropriate interval and circulates the heating heat-medium, and performs heating by using the radiant heat of the floor material heated by the heat of the heating heat-medium and natural convection of air. Since the warm air heater performs heating by forcibly convecting air, and the radiator and the floor heating device perform heating by using the radiant heat and the natural convection of air, the heating terminal 3 may be classified according to the heating method.

Figure 2:
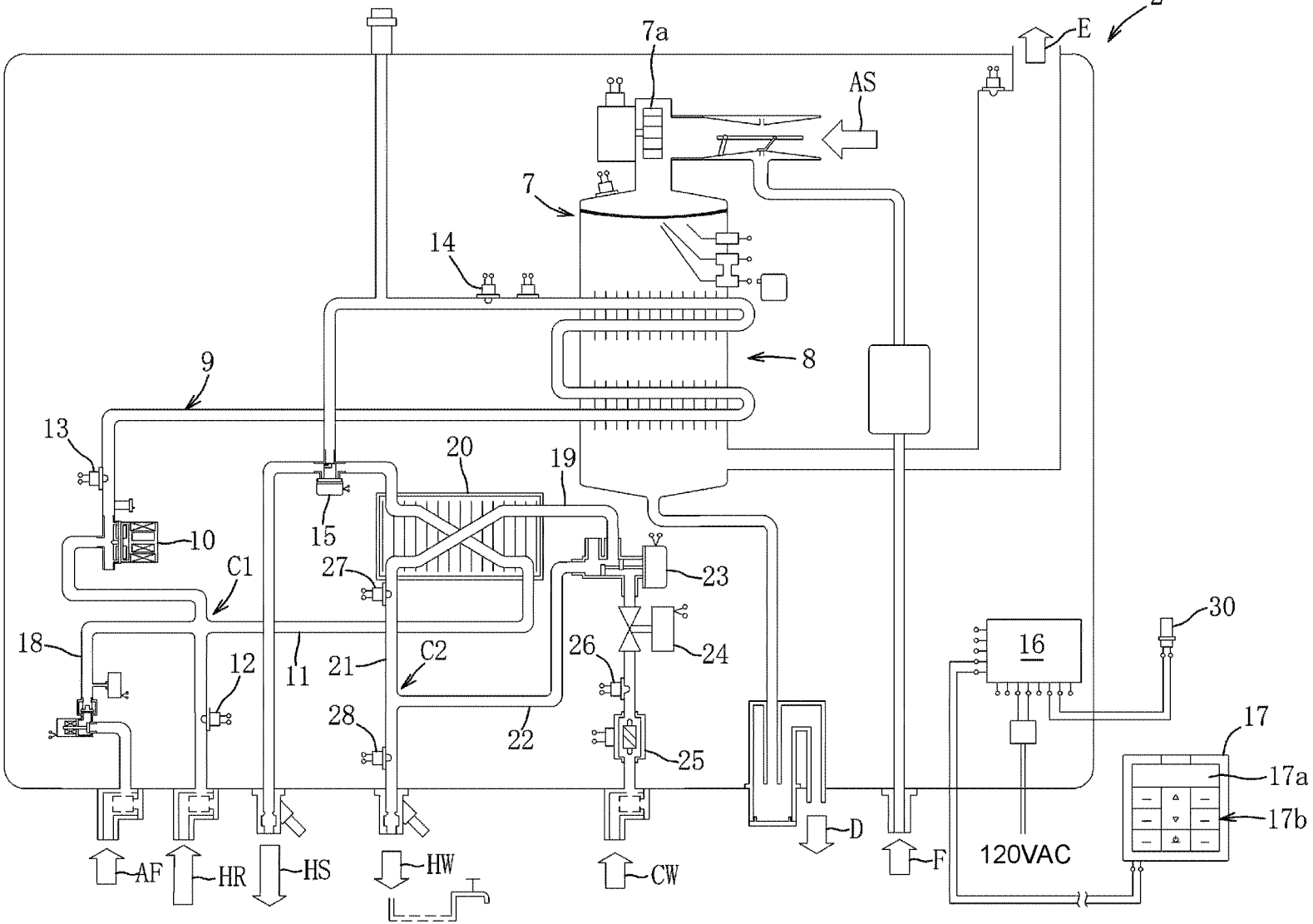
FIG. 2 is a view showing a configuration of a heating and hot-water supply device according to the above embodiment.

Next, the heating and hot-water supply device 2 will be described with reference to FIG. 2.

The heating and hot-water supply device 2 is configured to perform a heating operation which circulates the heating heat-medium heated by combustion heat generated by a combustion part 7 (combustion means) to and from the heating terminal 3, a hot-water supply operation which supplies hot water by adjusting tap water heated by the heat of the heating heat-medium to a hot-water supply setting temperature, and a simultaneous heating and hot-water supply operation which performs the heating operation and the hot-water supply operation in combination.

The heating and hot-water supply device 2 includes a combustion part 7, a heat exchanger 8, a circulation passage 9 connected to the heat exchanger 8 and the heating circulation circuit part 4*b* of the heating circulation circuit 4 which connects to the heating terminal 3, a built-in pump 10 (circulation means) provided upstream of the heat exchanger 8 of the circulation passage 9, and a control part 16 (control means) for performing various controls such as the control on the heating operation. The built-in pump 10 circulates the heating heat-medium in conjunction with the external pump 5 during the heating operation.

A mixed gas supplied by mixing, through driving of a combustion fan 7*a*, an air supply indicated by an arrow AS and a fuel gas indicated by an arrow F is burned at the combustion part 7. The heat of the combustion gas (combustion heat) generated by the combustion of the combustion part 7 is adjusted by the rotation speed of the combustion fan 7*a*. The heat exchanger 8 exchanges heat between the combustion gas generated in the combustion part 7 and the heating heat-medium flowing through the circulation passage 9 to heat the heating heat-medium to a predetermined target heat medium temperature. The combustion gas of which the temperature has decreased due to the heat exchange is exhausted to the outside as indicated by an arrow E.

In addition, the heating and hot-water supply device 2 includes a first bypass passage 11 (bypass passage), a hot-water supply heat exchanger 20 provided in the first bypass passage 11, a water supply passage 19, a hot-water supply passage 21, etc. To bypass the heating terminal connected to the heating circulation circuit 4, the first bypass passage 11 is branched off from the circulation passage 9 downstream of the heat exchanger 8 and is connected to the circulation passage 9 at a junction part C1 upstream of the built-in pump 10. The water supply passage 19 supplies tap water to the hot-water supply heat exchanger 20 as indicated by an arrow CW. The hot-water supply passage 21 supplies hot water heated by the hot-water supply heat exchanger 20 to a hot water tap or the like, as indicated by an arrow HW.

Next, the circulation passage 9 will be described.

The circulation passage 9 includes a first temperature sensor 12 (temperature detection means) on the upstream side (heating terminal 3 side) of the junction part C1 joining with the first bypass passage 11, includes a second temperature sensor 13 between the built-in pump 10 and the heat exchanger 8, and includes a third temperature sensor 14 downstream of the heat exchanger 8. The first temperature sensor 12 detects the temperature of the heating heat-medium which is used for heating and returns from the heating terminal of the heating circulation circuit 4 to the heat exchanger 8. The second temperature sensor 13 detects the temperature of the heating heat-medium flowing into the heat exchanger 8. The third temperature sensor 14 detects the temperature of the heating heat-medium heated by the heat exchanger 8. Based on the detection temperatures of these sensors, the combustion fan 7*a*, the built-in pump 10, the external pump 5, etc. are controlled by the control part 16 so that the temperature of the heating heat-medium which is heated becomes a target heat medium temperature (e.g., 70° C.).

A first distribution valve 15 (distribution means) is provided at a branching part of the circulation passage 9 and the first bypass passage 11. The first distribution valve 15 can adjust a distribution ratio to be adaptable to the heating operation, the hot-water supply operation, and the simultaneous heating and hot-water supply operation. The control part 16 adjusts the distribution ratio of the first distribution valve 15 to distribute the heating heat-medium heated by the heat exchanger 8 to the circulation passage 9 and the first bypass passage 11.

The distribution ratio of the first distribution valve 15 is adjusted to a heating operation distribution ratio of supplying the heating heat-medium only to the circulation passage 9 during the heating operation, and is adjusted to a hot-water supply operation distribution ratio of supplying the heating heat-medium only to the first bypass passage 11 during the hot-water supply operation. During the simultaneous heating and hot-water supply operation, with the distribution ratio of the first distribution valve 15 adjusted so that hot water supply is prioritized, the heating heat-medium is distributed to the circulation passage 9 and the first bypass passage 11. The heating heat-medium distributed to the circulation passage 9 is supplied to the heating circulation circuit 4 as indicated by an arrow HS. The heating heat-medium distributed to the first bypass passage 11 joins the heating heat-medium of the circulation passage 9 at the junction part C1. A replenishment passage 18 for replenishing the heating heat-medium as indicated by an arrow AF is connected between the built-in pump 10 and the first temperature sensor 12.

Next, the hot-water supply heat exchanger 20 will be described.

The hot-water supply heat exchanger 20 performs heat exchange between the heating heat-medium of the first bypass passage 11 and the tap water supplied from the water supply passage 19 to supply heated water to the hot-water supply passage 21. The water supply passage 19 includes a second distribution valve 23, a flow rate adjustment valve 24, a flow rate sensor 25, and an incoming water temperature sensor 26.

A second bypass passage 22 is branched off from the water supply passage 19, and the second distribution valve 23 which can adjust the distribution ratio is arranged at this branching part. The second distribution valve 23 distributes tap water to the second bypass passage 22 and the hot-water supply heat exchanger 20 to which the water supply passage 19 is connected. The flow rate adjustment valve 24 adjusts the flow rate of the tap water entering the second distribution valve 23. The flow rate sensor 25 detects the flow rate of the tap water entering the second distribution valve 23. The incoming water temperature sensor 26 detects the temperature of the tap water entering the second distribution valve 23.

The second bypass passage 22 is connected to the hot-water supply passage 21 at a junction part C2. A hot-water delivery temperature sensor 27 is provided between the junction part C2 of the hot-water supply passage 21 and the hot-water supply heat exchanger 20. The hot-water delivery temperature sensor 27 detects the temperature of the hot water delivered from the hot-water supply heat exchanger 20.

A hot-water supply temperature sensor 28 is provided downstream of the junction part C2 of the hot-water supply passage 21. The hot-water supply temperature sensor 28 detects a hot-water supply temperature of the water supply which is mixed from the water heated by the hot-water supply heat exchanger 20 and the tap water flowing through the second bypass passage 22. During the hot-water supply operation, the distribution ratio of the second distribution valve 23 is adjusted by the control part 16 so that the hot-water supply temperature can become a hot-water supply setting temperature which has been set.

Next, the control part 16 will be described with reference to FIG. 1 and FIG. 2.

The control part 16 is connected to an operation terminal 17 for performing setting operations on a heating setting temperature, a hot-water supply setting temperature, a target heat medium temperature, and the like, or performing operations of starting/stopping the heating operation, and the like. The operation terminal 17 includes a display part 17*a* capable of displaying information such as various temperatures and operating states, and a switch part 17*b* for performing a setting operation and the like. Further, the control part 16 is communicably connected to the heating terminal 3, the external pump 5, and an outside air temperature sensor 30 arranged outdoors, respectively, to acquire their operation information and the like.

Based on the detection signals of various sensors such as the first temperature sensor 12 which are communicatively connected, the control part 16 controls the combustion part 7 including the combustion fan 7*a*, the built-in pump 10, the external pump 5, the first distribution valve 15, the second distribution valve 23, the flow rate adjustment valve 24, etc. to control each of the heating operation, the hot-water supply operation, and the simultaneous heating and hot-water supply operation. The target heat medium temperature may be set by the control part 16 according to the heating setting temperature, and the heating setting temperature may be set by the control part 16 receiving a temperature set at the heating terminal 3.

Next, the hot-water supply operation will be described.

When hot water supply is started by opening the hot water tap or the like during standby and the flow rate sensor 25 detects a flow rate equal to or higher than a predetermined value at which the hot-water supply operation is started, the control part 16 starts combustion of the combustion part 7, drives the built-in pump 10, and adjusts the first distribution valve 15 to the hot-water supply operation distribution ratio so that the heating heat-medium is supplied only to the first bypass passage 11.

The heating heat-medium heated by the heat exchanger 8 to the target heat medium temperature by the combustion heat of the combustion part 7 heats the tap water supplied from the water supply passage 19 at the hot-water supply heat changer 20, and the heated water is circulated in the hot-water supply passage 21. Based on the water temperature detected by the hot-water delivery temperature sensor 27 and the tap water temperature detected by the incoming water temperature sensor 26, the control part 16 adjusts the distribution ratio of the second distribution valve 23 to control the mixing ratio of the water at the junction part C2 so that the temperature detected by the hot-water supply temperature sensor 28 can become the hot-water supply setting temperature. When the hot water tap or the like is closed and the flow rate sensor 25 does not detect a flow rate equal to or higher than the predetermined value, the control part 16 ends the hot-water supply operation and stands by.

Next, the heating operation will be described.

When the heating operation is started by an operation of the warm air heater 3 or the operation terminal 17 during standby, the control part 16 starts combustion of the combustion part 7, drives the external pump 5 and the built-in pump 10, and adjusts the first distribution valve 15 so that the heating heat-medium is supplied only to the circulation passage 9 to supply the heating heat-medium to the heating circulation circuit 4. After the heating heat-medium heated by the heat exchanger 8 to the target heat medium temperature by the combustion heat of the combustion part 7 is supplied to the heating terminal 3 for heating, a part of it is returned to the heat exchanger 8 of the heating and hot-water supply device 2 to be re-heated. When the heating operation is stopped by an operation of the operation terminal 17 or the like, the control part 16 stops the combustion of the combustion part 7 and the like and stands by.

Next, the transition from the heating operation to the simultaneous heating and hot-water supply operation will be described.

During the heating operation, the room temperature basically stabilizes at around the heating setting temperature soon after the start of the heating operation, and since the temperature drop of the heating heat-medium due to heating is unlikely to increase, there is a margin in the combustion heat generated by the combustion part 7. During the heating operation, when the hot water tap or the like is opened to start hot water supply and the flow rate sensor 25 detects a flow rate equal to or higher than the predetermined value, the control part 16 transitions to the simultaneous heating and hot-water supply operation by adjusting the distribution ratio of the first distribution valve 15 to also supply the heating heat-medium to the first bypass passage 11.

Further, the control part 16 increases the combustion heat generated by the combustion part 7 so that the heating heat-medium, of which the temperature drops significantly in simultaneously performing heating and hot water supply, can be heated to the target heat medium temperature.

When transitioning to the simultaneous heating and hot-water supply operation, hot water supply is prioritized, and in order to supply warm water supply quickly and not to cause discomfort to a hot water user, the first distribution valve 15 is adjusted so that the heating heat-medium distributed to the first bypass passage 11 is more than that to the circulation passage 9. When the heating terminal 3 for performing heating is a warm air heater which heats by forcibly convecting air, a temperature drop of the warm air which directly hits the human body is easily perceived. Therefore, when the heat supplied from the heating and hot-water supply device 2 to the heating circulation circuit 4 decreases, it may cause a heating user to feel cold and thus cause discomfort. On the other hand, when the heating terminal 3 for performing heating is a radiator or a floor heating device which heats by radiant heat or natural convection of air, the human body does not easily perceive the radiant heat or the like. Therefore, even if the heat supplied from the heating and hot-water supply device 2 to the heating circulation circuit 4 decreases, there is little possibility that the heating user will immediately feel cold.

As an example, Embodiment 1 shows a case where a warm air heater is installed as the heating terminal 3. Therefore, when predetermined raise conditions are satisfied at the time of transition to the simultaneous heating and hot-water supply operation, the target heat medium temperature is temporarily increased to compensate for the decrease in the supplied heat.

Figure 3:
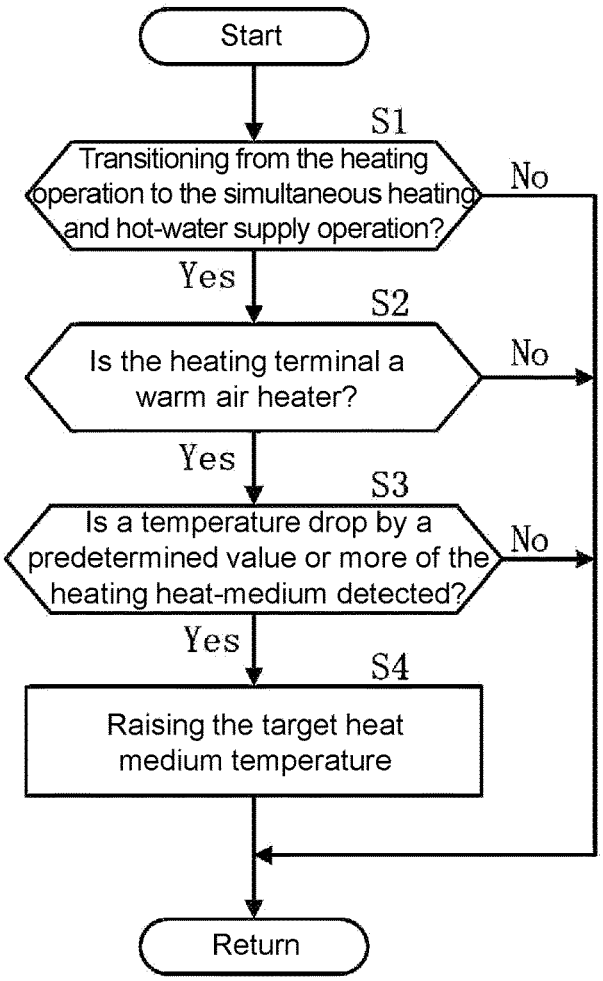
FIG. 3 is a flowchart of distribution ratio control at the time of a simultaneous heating and hot-water supply operation according to Embodiment 1.

Next, distribution ratio control (this control is executed by the control part 16) at the time of transition to the simultaneous heating and hot-water supply operation for controlling the distribution ratio of the first distribution valve 15 at the time of transition to the simultaneous heating and hot-water supply operation will be described based on the flowchart of FIG. 3. In the figure, Si (i=1, 2, . . . ) represents a step.

In S1, it is determined whether it is a transition from the heating operation to the simultaneous heating and hot-water supply operation. If the determination is "Yes", the process proceeds to S2, and if the determination is "No", the process returns without raising the target heat medium temperature. Next, in S2, it is determined whether the heating terminal 3 is a warm air heater. If the determination is "Yes", the process proceeds to S3, and if the determination is "No", the process returns without raising the target heat medium temperature.

Next, in S3, it is determined whether the temperature of the heating heat-medium returning to the heat exchanger 8 of the heating and hot-water supply device 2 drops by a predetermined value or more due to the transition from the heating operation to the simultaneous heating and hot-water supply operation. For example, it is determined whether the temperature of the heating heat-medium detected by the first temperature sensor 12 has dropped by a temperature of a predetermined value or more (e.g., 10° C. or more) before and after the transition to the simultaneous heating and hot-water supply operation.

After transitioning to the simultaneous heating and hot-water supply operation, it takes a time corresponding to the length of the heating circulation circuit 4 for the heating heat-medium used for heating supplied from the heating and hot-water supply device 2 to return to the heating and hot-water supply device 2. Therefore, the determination of S4 is performed after a predetermined time, e.g., 1 minute, after the transition to the simultaneous heating and hot-water supply operation. The predetermined time is set at the time of installation according to the hot-water heating system 1. If the determination is "Yes", the process proceeds to S4, and if the determination is "No", the process returns without raising the target heat medium temperature. If the hot water supply is ended before the determination, the process returns.

Next, in S4, the target heat medium temperature is raised, and then the process returns.

The raise value of the target heat medium temperature at this time is a predetermined temperature such as 20° C. In addition, in order to compensate for the decrease in the heat supplied to the warm air heater while suppressing excessive combustion, for example, the raise value may be calculated so that the detection temperature of the first temperature sensor 12 returns to the temperature at the time of the heating operation. In order not to exceed an upper limit value (e.g., 95° C.) set in advance for safety, the target heat medium temperature is limited to be the upper limit value or less.

In the case of raising the target heat medium temperature, the control part 16 increases the combustion heat of the combustion part 7 to bring the temperature of the heating heat-medium as heated close to the raised target heat medium temperature. By raising the target heat medium temperature, the decrease in the heat supplied to the warm air heater during the simultaneous heating and hot-water supply operation is compensated for to suppress a temperature drop of the warm air of the warm air heater.

Figure 4:
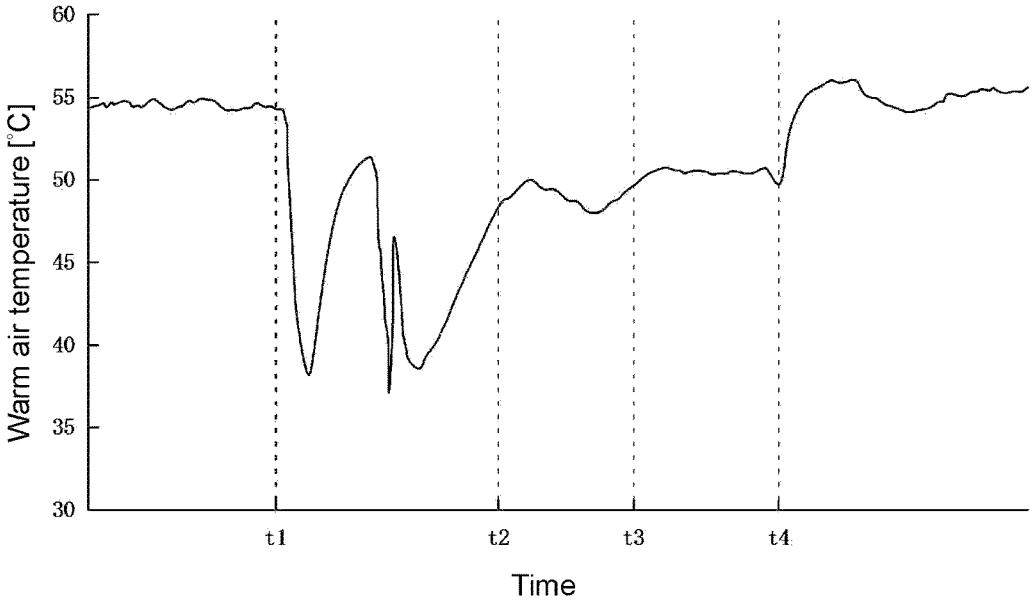
FIG. 4 is a graph showing an actual measurement example of a warm air temperature upon performing raise control of a target heat medium temperature.

FIG. 4 shows an example in which the change in the warm air temperature of the warm air heater 3 arising from the control of raising the target heat medium temperature was actually measured. Before time t1, the heating operation is performed with the target heat medium temperature being 70° C., and the warm air temperature stabilizes at around 55° C. Upon transitioning to the simultaneous heating and hot-water supply operation at time t1, since hot water supply is prioritized and the heat supplied from the heating and hot-water supply device 2 fluctuates until the hot-water supply temperature is stabilized, the warm air temperature fluctuates significantly, and from around time t2, the warm air temperature stabilizes at a temperature lower than that during the heating operation. At time t3 after a predetermined time has elapsed from time t1, the first temperature sensor 12 detects that the heating heat-medium has a temperature drop of the predetermined value or more, and the target heat medium temperature is raised by a calculated temperature (e.g., 22° C.). The heating heat-medium, which has become a high temperature, begins to reach the warm air heater 3 from time t4 and the warm air temperature rises, and afterwards, the warm air temperature is stabilized at substantially the same temperature as during the heating operation.

When the raise condition of S3 is omitted and the raise conditions of S1 and S2 are satisfied, the target heat medium temperature may be raised by a predetermined raise value. The heat supplied to the warm air heater can be increased at the time of transition from the heating operation to the simultaneous heating and hot-water supply operation to suppress the temperature drop of the warm air of the warm air heater. Since the heat supplied to the warm air heater is increased before the first temperature sensor 12 detects a drop in the detection temperature, the temperature drop of the warm air of the warm air heater can be suppressed at an early stage.

Further, the raise condition of S3 may also be changed to a condition that the detection temperature of the first temperature sensor 12 becomes a predetermined temperature or lower, so that the distribution ratio control during the simultaneous heating and hot-water supply operation can be repeated performed during the simultaneous heating and hot-water supply operation. For example, although it was not necessary to raise the target heat medium temperature at the beginning of the transition to the simultaneous heating and hot-water supply operation, the supplied heat can be increased when the temperature of the warm air of the warm air heater 3 drops due to an increase in the hot-water supply flow rate or the like during the simultaneous heating and hot-water supply operation. In addition, the sequence of determination of the raise conditions of S1 to S3 may be changed.

When the hot water tap or the like is closed and the flow rate sensor 25 does not detect a flow rate equal to or higher than the predetermined value, the control part 16 adjusts the first distribution valve 15 so as to supply the heating heat-medium only to the circulation passage 9 and transitions from the simultaneous heating and hot-water supply operation to the heating operation. At this time, the target heat medium temperature is returned to the original setting value.

The action and effect of the above heating and hot-water supply device 2 will be described.

Since the heating and hot-water supply device 2 raises the target heat medium temperature when transitioning from the heating operation to the simultaneous heating and hot-water supply operation in the case where the heating terminal 3 is a warm air heater, the temperature of the heating heat-medium heated by the heat exchanger 8 becomes higher than that during the heating operation. Therefore, even if the heating heat-medium is distributed for the hot-water supply operation and the flow rate of the heating heat-medium supplied to the warm air heater drops, since the heat supplied to the warm air heater is compensated for, it is possible to suppress a temperature drop of the warm air blown by the warm air heater.

Also, when the process transitions from the heating operation to the simultaneous heating and hot-water supply operation, in the case where the temperature of the heating heat-medium which is used and returned to the heat exchanger 8 drops by a predetermined value or more compared to the temperature during the heating operation, the target heat medium temperature is raised to make the temperature of the heating heat-medium higher than that during the heating operation. When there is a possibility that the temperature drop of the warm air of the warm air heater is large, since the heat supplied to the warm air heater can be increased by the temperature rise of the heating heat-medium, it is possible to suppress a temperature drop of the warm air of the warm air heater.

Moreover, the temperature of the heating heat-medium which is used for heating and returned to the heat exchanger 8 before merging with the heating heat-medium used for hot water supply is detected, and it is possible to learn the temperature required to suppress the temperature drop of the warm air of the warm air heater. Therefore, when raising the target heat medium temperature, it is possible to set an appropriate target heat medium temperature and suppress the temperature drop of the warm air of the warm air heater.

When the heating operation is started during the hot-water supply operation, it is possible that the heating operation is not started until the hot water supply is ended in order to prioritize the hot water supply, or the operation may transition to the simultaneous heating and hot-water supply operation. In the case of transitioning to the simultaneous heating and hot-water supply operation, the target heat medium temperature may be temporarily raised in the same manner as described above.

Embodiment 2

As an example, Embodiment 2 shows that a warm air heater and a radiator and/or a floor heating device are installed as the heating terminal 3. Therefore, at the time of transition from the heating operation to the simultaneous heating and hot-water supply operation, considering that the effect on the decrease in the heat supplied to the heating terminal 3 differs depending on the type or the heating method of the heating terminal 3, the first distribution valve 15 is adjusted from the heating operation distribution ratio to a different distribution ratio according to the type or the heating method of the heating terminal 3 at the time of transition from the heating operation to the simultaneous heating and hot-water supply operation. Since this embodiment is similar to Embodiment 1 in terms of the configurations shown in FIG. 1 and FIG. 2, descriptions thereof will be omitted.

Figure 5:
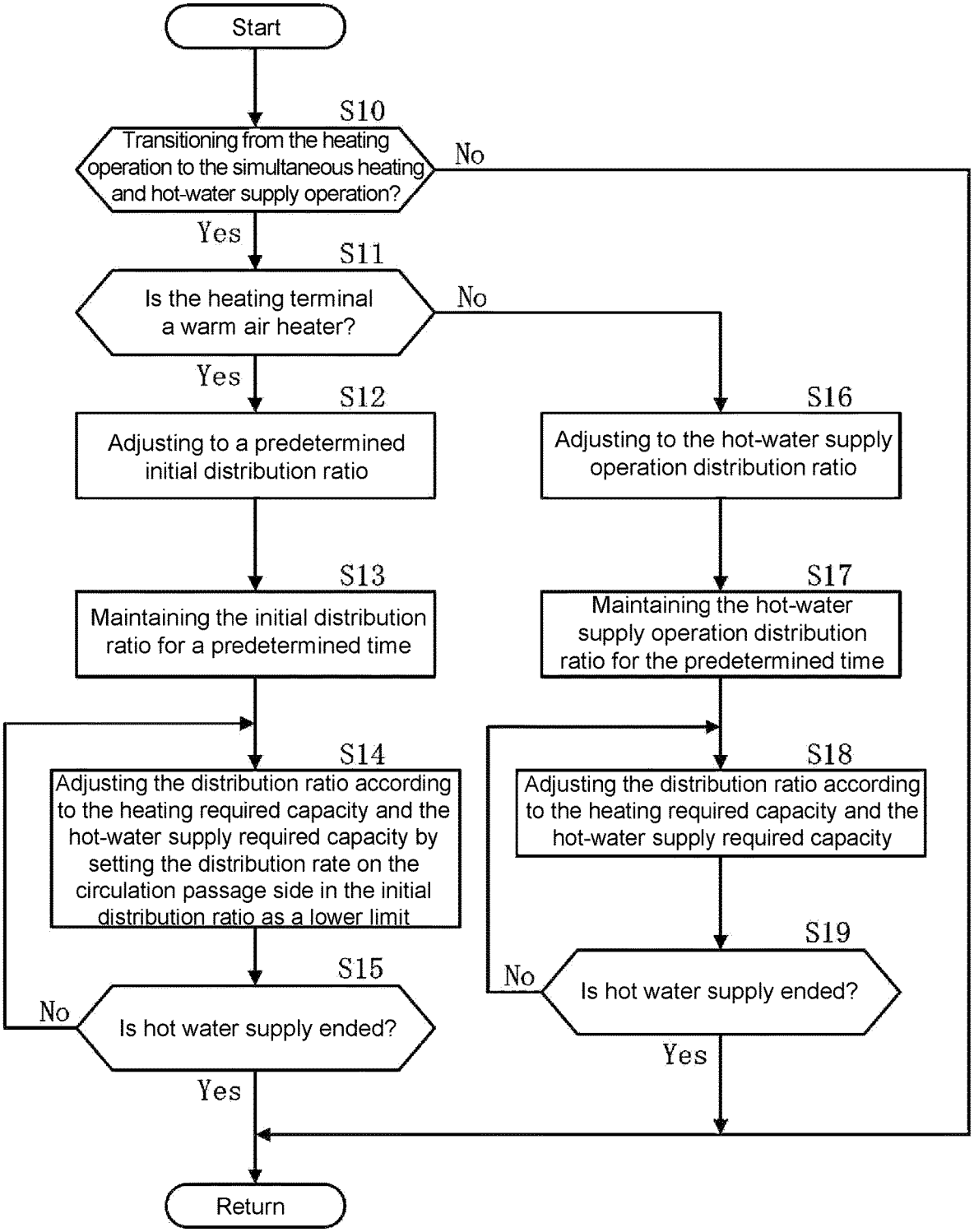
FIG. 5 is a flowchart of distribution ratio control at the time of a simultaneous heating and hot-water supply operation according to Embodiment 2.

Next, distribution ratio control (this control is executed by the control part 16) at the time of transition to the simultaneous heating and hot-water supply operation for controlling the distribution ratio of the first distribution valve 15 at the time of transition to the simultaneous heating and hot-water supply operation will be described based on the flowchart of FIG. 5. In the figure, Si (i=10, 11, . . . ) represents a step.

In S10, it is determined whether it is a transition from the heating operation to the simultaneous heating and hot-water supply operation. If the determination is "Yes", the process proceeds to S11, and if the determination is "No", the process returns and the heating operation continues. Next, in S11, it is determined whether the heating terminal 3 for performing heating is a warm air heater. If the determination is "Yes", the process proceeds to S12, and if the determination is "No", the process proceeds to S16.

In S12, when the heating terminal 3 is a warm air heater, the first distribution valve 15 is adjusted to a distribution ratio which is a predetermined initial distribution ratio set in advance and is different from the hot-water supply operation distribution ratio, and the process proceeds to S13. The initial distribution ratio is set so that the drop in the warm air temperature of the warm air heater is made small and warm water supply can be supplied quickly, and for example, it may be set to distribute: circulation passage 9 side: first bypass passage 11 side=3:7.

Next, in S13, the initial distribution ratio of the first distribution valve 15 adjusted in S12 is maintained for a predetermined time (e.g., 10 seconds), and the process proceeds to S14. This predetermined time may be appropriately set according to, for example, the time required for the water supply having a temperature close to the hot-water supply setting temperature to be supplied from the hot-water supply passage 21.

Next, in S14, by adjusting the distribution ratio so that the distribution rate on the circulation passage 9 side in the initial distribution ratio is a lower limit, the distribution ratio of the first distribution valve 15 is adjusted according to a hot-water supply required capacity and a heating required capacity, and the process proceeds to S15. The hot-water supply required capacity is a heating capacity corresponding to a heat calculated based on a hot-water supply flow rate detected by the flow rate sensor 25, an incoming water temperature detected by the incoming water temperature sensor 26, and the hot-water supply setting temperature. The heating required capacity is a heating capacity corresponding to a heat calculated based on a heating heat-medium flow rate detected by the built-in pump 10, a heating heat-medium return temperature detected by the first temperature sensor 12, and the heating heat-medium target temperature.

Even if the hot-water supply required capacity is large, of the heat supplied by the heating and hot-water supply device 2, at least a heat corresponding to the distribution rate on the circulation passage 9 side in the initial distribution ratio is secured for the warm air heater.

Next, in S15, it is determined whether the hot water supply is ended. If the determination is "Yes", the process returns to the original heating operation, and if the determination is "No", the process returns to S14 and continues the simultaneous heating and hot-water supply operation.

On the other hand, when the heating terminal 3 is not a warm air heater, in S16, the first distribution valve 15 is adjusted to the hot-water supply operation distribution ratio, and the process proceeds to S17. Although the heat is not supplied to the heating circulation circuit 4 since the hot-water supply operation distribution ratio is a distribution ratio which supplies the full amount of the heating heat-medium which has been heated to the first bypass passage 11, the heating continues by the heat stored in the heating heat-medium which circulates in the terminal circulation circuit part 4*a*.

Next, in S17, the hot-water supply operation distribution ratio of the first distribution valve 15 adjusted in S16 is maintained for the same predetermined time as in S13, and the process proceeds to S18. Next, in S18, the distribution ratio of the first distribution valve 15 is adjusted according to the heating required capacity and the hot-water supply required capacity, and the process proceeds to S19. If the hot-water supply required capacity is large, it is possible to maintain the hot-water supply operation distribution ratio. Next, in S19, it is determined whether the hot water supply is ended. If the determination is "Yes", the process returns to the original heating operation, and if the determination is "No", the process returns to S18 and continues the simultaneous heating and hot-water supply operation. In addition, it is also possible to perform distribution ratio control according to the heating method by setting S11 as a step of determining whether the heating terminal 3 involves a heating method of forcibly convecting air.

The action and effect of the heating and hot-water supply device 2 of Embodiment 2 will be described.

When transitioning from the heating operation to the simultaneous heating and hot-water supply operation, if the heating terminal 3 for performing heating is not a warm air heater, the first distribution valve 15 is adjusted from the heating operation distribution ratio to the hot-water supply operation distribution ratio to prioritize the hot-water supply operation. In addition, when transitioning from the heating operation to the simultaneous heating and hot-water supply operation, if the heating terminal 3 for performing heating is a warm air heater, to supply the heating heat-medium respectively to the hot-water supply side and the heating side, the first distribution valve 15 is adjusted from the heating operation distribution ratio to a predetermined initial distribution ratio of the device which is different from the hot-water supply operation distribution ratio. Accordingly, it is possible to supply more heating heat-medium to the warm air heater than in the case of the hot-water supply operation distribution ratio to alleviate the temperature drop of the warm air.

Accordingly, when transitioning from the heating operation to the simultaneous heating and hot-water supply operation, considering that the effect on the decrease in the supplied heat differs depending on the type of the heating terminal 3, by adjusting the first distribution valve 15 to a distribution ratio according to the type of the heating terminal 3, it is possible to reduce the possibility of causing discomfort to the heating user while hot water supply is prioritized and discomfort is not caused to the hot water user.

Also, at the beginning of the transition from the heating operation to the simultaneous heating and hot-water supply operation, after a predetermined time has elapsed with the first distribution valve 15 adjusted at the initial distribution ratio or with the first distribution valve 15 adjusted at a distribution ratio prioritizing the hot-water supply operation, the first distribution valve 15 is adjusted according to the heating required capacity required for the heating operation and the hot-water supply required capacity required for the hot-water supply operation. Therefore, after lapse of the predetermined time from the transition to the simultaneous heating and hot-water supply operation, since heat can be supplied to the heating terminal 3, it is possible to reduce the possibility of causing discomfort to the heating user.

In the case where the heating terminal 3 for performing heating is a warm air heater, even if the hot-water supply required capacity is large, it is possible to maintain at least the distribution rate on the circulation passage 9 side in the initial distribution ratio and secure the heat to be supplied to the warm air heater. Therefore, it is possible to suppress the temperature drop of the warm air sent from the warm air heater and reduce the possibility of causing discomfort to the heating user.

If the heating operation is started during the hot-water supply operation, it is possible that the heating operation is not started until the hot water supply is ended in order to prioritize the hot water supply, or the operation may transition to the simultaneous heating and hot-water supply operation. In the case of transitioning to the simultaneous heating and hot-water supply operation, the combustion of the combustion part 7 is increased, and while the heat supplied to the first bypass passage 11 side corresponding to the hot-water supply required capacity is maintained, the first distribution valve 15 is adjusted so as to also supply the heating heat-medium to the circulation passage 9 side.

Further, when the heating terminal 3 is a combination of a warm air heater and a radiator, the first distribution valve 15 is adjusted in the same manner as in the case where the heating terminal 3 is a warm air heater, but if the blower of the warm air heater is not driven, the same control as in the case where the heating terminal 3 is not a warm air heater may also be performed.

A person skilled in the art can implement the embodiments in forms in which various modifications are added to the above-described embodiments without departing from the spirit of the disclosure, and the disclosure includes such modification forms.

What is claimed is:

1. A heating and hot-water supply device comprising:

a combuster;

a heat exchanger for heating a heating heat-medium to a target heat medium temperature by heat generated by the combuster;

a circulation passage for connecting the heat exchanger to an external heating terminal;

a built-in pump provided in the circulation passage to circulate the heating heat-medium;

a bypass passage branched off from the circulation passage and bypassing the heating terminal;

a distribution valve for distributing the heating heat-medium to the circulation passage and the bypass passage;

a hot-water supply heat exchanger provided in the bypass passage;

a water supply passage for supplying tap water to the hot-water supply heat exchanger; and a hot-water supply passage for supplying water, which is heated by the hot-water supply heat exchanger, at a predetermined hot-water supply setting temperature, wherein the heating and hot-water supply device is configured to control at least the combuster, the built-in pump, and the distribution valve, and the heating and hot-water supply device is capable of adjusting a distribution ratio of the distribution valve to be adaptable to a heating operation, a hot-water supply operation, and a simultaneous heating and hot-water supply operation, and at the time of transition from the heating operation to the simultaneous heating and hot-water supply operation, in a case where the heating terminal for performing heating is a warm air heater, the heating and hot-water supply device raises the target heat medium temperature, and in a case where the heating terminal is not a warm air heater, the heating and hot-water supply device doesn't change the target heat medium temperature.

2. The heating and hot-water supply device according to claim 1, comprising a temperature sensor for detecting a temperature of the heating heat-medium returning from the heating terminal to the heat exchanger, wherein the heating and hot-water supply device raises the target heat medium temperature on condition that a detection temperature of the temperature sensor drops by a predetermined value or more due to the transition from the heating operation to the simultaneous heating and hot-water supply operation.

3. The heating and hot-water supply device according to claim 2, wherein the temperature sensor is arranged on a heating terminal side of a junction part of the circulation passage and the bypass passage.

* * * * *